US009723931B2

(12) United States Patent
Lu

(10) Patent No.: US 9,723,931 B2
(45) Date of Patent: Aug. 8, 2017

(54) SLEEVE FOR INSTALLING HINGE

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 15/189,266

(22) Filed: Jun. 22, 2016

(65) Prior Publication Data

US 2016/0286969 A1 Oct. 6, 2016

(30) Foreign Application Priority Data

Mar. 17, 2016 (CN) ..... 2016 1 0153985

(51) Int. Cl.

| | |
|---|---|
| ***A47C 17/86*** | (2006.01) |
| ***A47C 7/38*** | (2006.01) |
| ***A47C 17/04*** | (2006.01) |
| ***A47C 7/40*** | (2006.01) |

(52) U.S. Cl.

CPC ..... *A47C 17/86* (2013.01); *A47C 7/38* (2013.01); *A47C 7/402* (2013.01); *A47C 17/04* (2013.01); *Y10T 16/05* (2015.01)

(58) Field of Classification Search

CPC ..... A47C 17/86; A47C 7/38; A47C 7/402; A47C 17/04; Y10T 16/05; Y10T 16/540247; B60N 2/4838; B60N 2/4814; B60N 2/48; B60N 2/4817; F16L 5/00

USPC ..... 16/2.1, 326; 297/391, 410; 248/407, 118

See application file for complete search history.

(56) References Cited

U.S. PATENT DOCUMENTS

| | | | | | |
|---|---|---|---|---|---|
| 4,527,834 | A * | 7/1985 | Zyngier | B60N 2/4817 | 248/414 |
| 5,156,440 | A * | 10/1992 | Vidwans | B60N 2/4814 | 297/410 |
| 5,529,379 | A * | 6/1996 | Stocker | B60N 2/4817 | 297/410 |
| 5,788,250 | A * | 8/1998 | Masters | B60N 2/4826 | 297/391 |
| 5,816,658 | A * | 10/1998 | Wallis | B60N 2/4814 | 297/391 |
| 6,454,356 | B1 * | 9/2002 | Yamada | B60N 2/4814 | 297/391 |
| 7,954,899 | B2 * | 6/2011 | Chen | B60N 2/4808 | 297/391 |

(Continued)

*Primary Examiner* — William Miller
(74) *Attorney, Agent, or Firm* — Shimokaji IP

(57) ABSTRACT

A sleeve for installing hinge is provided, a mounting hole is opened in a top plate, wherein the sleeve for installing hinge comprises a main body capable of inserting into the mounting hole and a stopper fixed to an upper end of the main body and withstood with a top surface of the top plate, a slot where a hinge is inserted therein is opened in the sleeve for installing hinge, the slot passes through the stopper and extends down into the main body, a hook is configured at a side wall of the main body, the hook is deformed under pressure so as to allow the main body and the hook to pass through the mounting hole, the hook has a stop surface facing up, after the main body and the hook pass through the mounting hole, the stop surface faces a bottom surface of the top plate.

9 Claims, 11 Drawing Sheets

(56) References Cited

U.S. PATENT DOCUMENTS

| | | | | |
|---|---|---|---|---|
| 8,075,060 | B2 * | 12/2011 | Gans | B60N 2/4817 297/410 |
| 8,313,148 | B2 * | 11/2012 | Lardies | B60N 2/4814 297/391 |
| 8,661,619 | B2 * | 3/2014 | Lu | A47C 17/86 16/321 |
| 9,187,017 | B2 * | 11/2015 | Ronzi | B60N 2/4811 |
| 2009/0315368 | A1 * | 12/2009 | Mitchell | B60R 11/0235 297/188.04 |

* cited by examiner

SLEEVE FOR INSTALLING HINGE

RELATED APPLICATIONS

This application claims the benefit of priority to Chinese Patent Application No. 201610153985.0 filed in Mar. 17, 2016, which is hereby incorporated by reference in its entirety.

FIELD OF THE INVENTION

The present invention relates to a field of furniture parts, more particularly to a sleeve for installing a hinge.

BACKGROUND OF THE INVENTION

Commonly, angles of a headrest of a sofa can be adjusted to meet the requirement of the customers. One of the achievement manners is to set a hinge connected between a sofa body and the headrest in the sofa. As shown in FIG. 1, one end of the hinge a is installed to the sofa body b, the other end of the hinge a is installed to the headrest c, as the hinge a has a pivot joint, the headrest c is capable of swinging relative to the sofa body b so as to change the angle thereof. Combined with FIG. 2, the hinge a is mounted to the sofa body b via a metal sleeve d. A top plate b1 is fixed on an upper end of the sofa body b, has a thread is configured on the peripheral wall of the sleeve d and screwed up in the top plate b1, and then inserting a lower end of the hinge a so as to complete the installation.

The conventional sleeve for installing hinge has the following disadvantages: the sleeve need to be screwed in the top plate, which is time-consuming, and it is difficult to remove the sleeve once it is screwed therein; as the sleeve is configured with the thread, so the material of the sleeve must be metal, which increases the manufacturing costs.

Therefore, it is necessary to provide a sleeve for installing hinge having quick and easy installation, and low cost.

SUMMARY OF THE INVENTION

One objective of the present invention is to provide a sleeve for installing hinge having quick and easy installation, and low cost.

To achieve the above objective, a sleeve for installing hinge is provided, the sleeve for installing hinge is installed in a top plate of a sofa body and adapted for installing a hinge, a mounting hole is opened in the top plate, wherein the sleeve for installing hinge comprises a main body capable of inserting into the mounting hole and a stopper fixed to an upper end of the main body and withstood with a top surface of the top plate, a slot where the hinge is inserted therein is opened in the sleeve for installing hinge, the slot passes through the stopper and extends down into the main body, a hook is configured at a side wall of the main body, the hook is deformed under pressure so as to allow the main body and the hook to pass through the mounting hole, the hook has a stop surface facing up, after the main body and the hook pass through the mounting hole, the stop surface faces a bottom surface of the top plate.

In comparison with the prior art, the side wall of the main body of the sleeve for installing hinge is provided with the hook capable of being deformed, when installing the sleeve for installing hinge, simply compress and deform the hook so that the main body can be inserted into the mounting hole in the top plate, after inserting the main body, the stopper of the main body is withstood with the top surface of the top plate, and the hook regains its initial shape, the stop surface thereof is located under the bottom surface and faces the bottom surface, the stopper and the stop surface together position the sleeve for installing hinge in the top plate, then the hinge can be inserted in the slot on the sleeve for installing hinge, and then the installation is completed. The installation process is quick and easy. Further, the sleeve for installing hinge without thread can be made of plastic and other materials, which saves manufacturing costs.

Preferably, a receiving groove recessed inwardly is opened in the side wall of the main body, one end of the hook is configured in the receiving groove, the stop surface is configured at the other end of the hook and located outside the receiving groove, and the stop surface is pressed into the receiving groove when the hook is deformed. As the hook is configured in the receiving groove, so when the hook is pressed, the hook could be deformed into the receiving groove, and the stop surface could be received in the receiving groove, thereby the main body could be inserted in the mounting hole without interference.

Preferably, an upper end of the hook is configured in the receiving groove, the stop surface is configured at a lower end of the hook, the lower end of the hook further comprises an inclined surface located under the stop surface and outside the receiving groove, and the hook is urged to be deformed by the inclined surface under pressure. As the inclined surface is configured at the hook, so during the process that the main body is inserted into the mounting hole, the inclined surface is withstood with the edge of the mounting hole, the inclined surface under pressure urges the hook to be deformed automatically without pressing the hook manually, it is easy to operate.

Preferably, the receiving groove communicates with the slot.

Preferably, the number of the receiving groove is two, and each of the two receiving grooves is provided with one said hook. Each of the two hook has a stop surface facing the bottom surface of the top plate, which increase the stability thereof, and prevent the hook from falling off from the top plate.

Preferably, a recessed positioning groove is opened in the side wall of the main body, a first through hole is opened in a bottom surface of one end of the positioning groove, the first through hole passes through the side wall of the main body and communicates with the slot, one end of the hinge inserted into the slot has an engaging groove, a clamp spring is configured in the positioning groove, and a portion of the clamp spring extends into the slot through the first through hole and engages in the engaging groove. The clamp spring is configured in the positioning groove and engages in the engaging groove, thereby the hinge can be locked in the slot.

Preferably, the main body is in a shape of a cylinder, the positioning groove is in a shape of a circular arc.

Preferably, a second through hole opposite to the first through hole is opened through the side wall of the main body, the clamp spring comprises an curved edge and a straight edge, the curved edge engages in the positioning groove, one end of the straight edge is fixed to the curved edge, the straight edge enters into the slot and engages in the engaging groove, the other end of the straight edge extends into the second through hole.

Preferably, when a tail end of the hinge is withstood with a bottom of the slot, the engaging groove and the positioning groove are at the same elevation.

Preferably, a positioning hole is opened in the bottom of the slot, the tail end of the hinge has a positioning portion, the positioning portion engages in the positioning hole. The positioning hole matches with the positioning portion, which realizes the positioning of the hinge in the slot.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
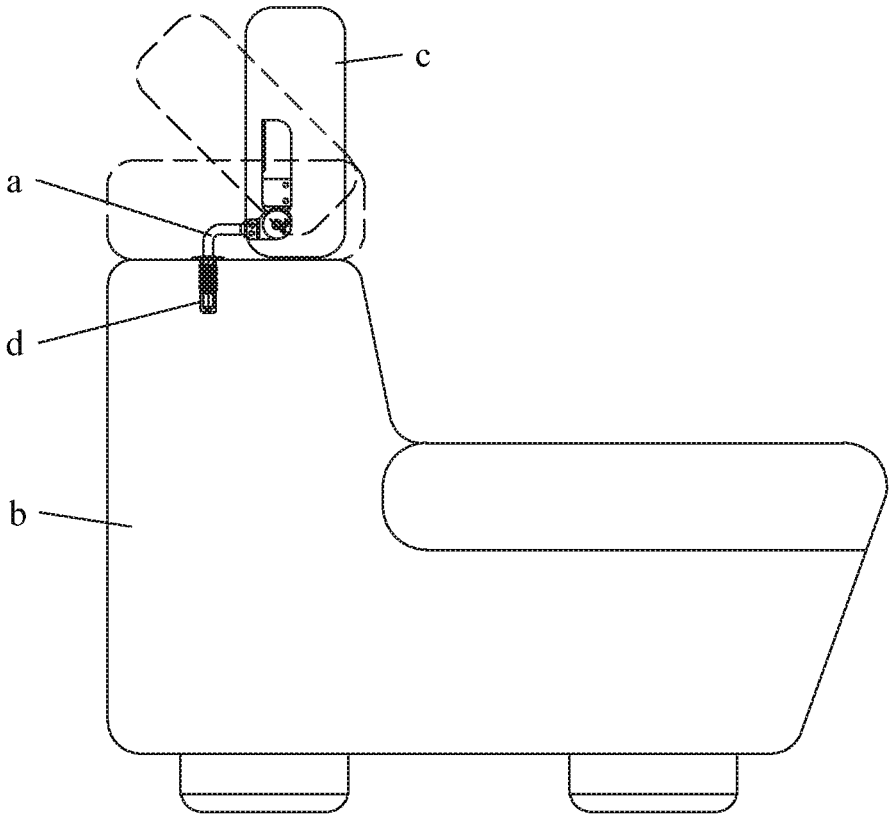
Fig. 1 (Prior Art)
FIG. 1 is a schematic view of a conventional sleeve and a hinge installed in a sofa showing that a headrest swings relative to a sofa body.
Figure 2:
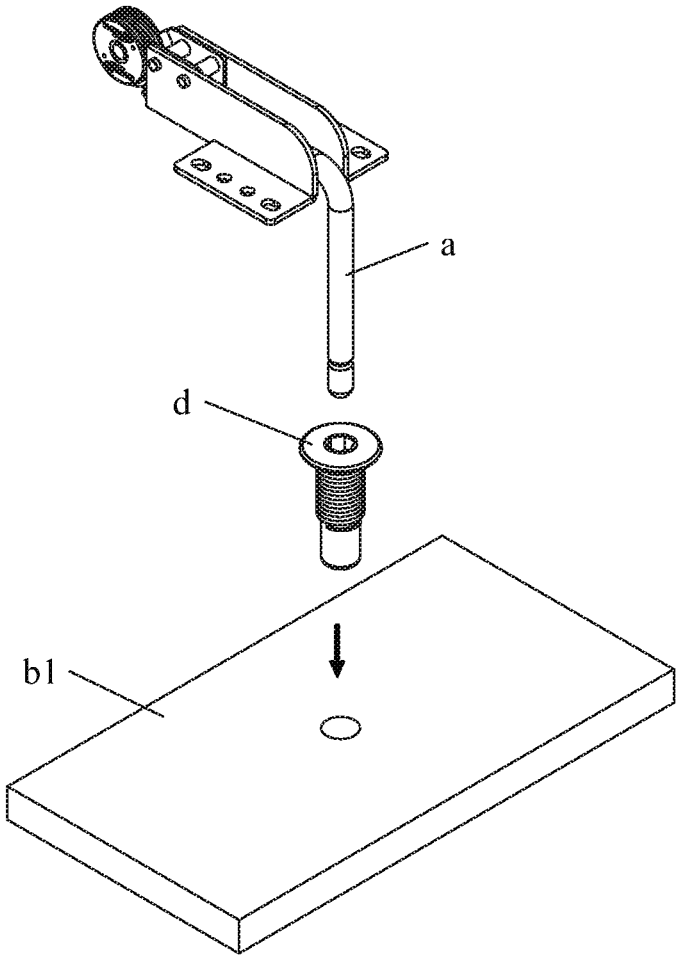
Fig. 2 (Prior Art)
FIG. 2 is a perspective view of the conventional sleeve and the hinge showing the installation method thereof.
Figure 3:
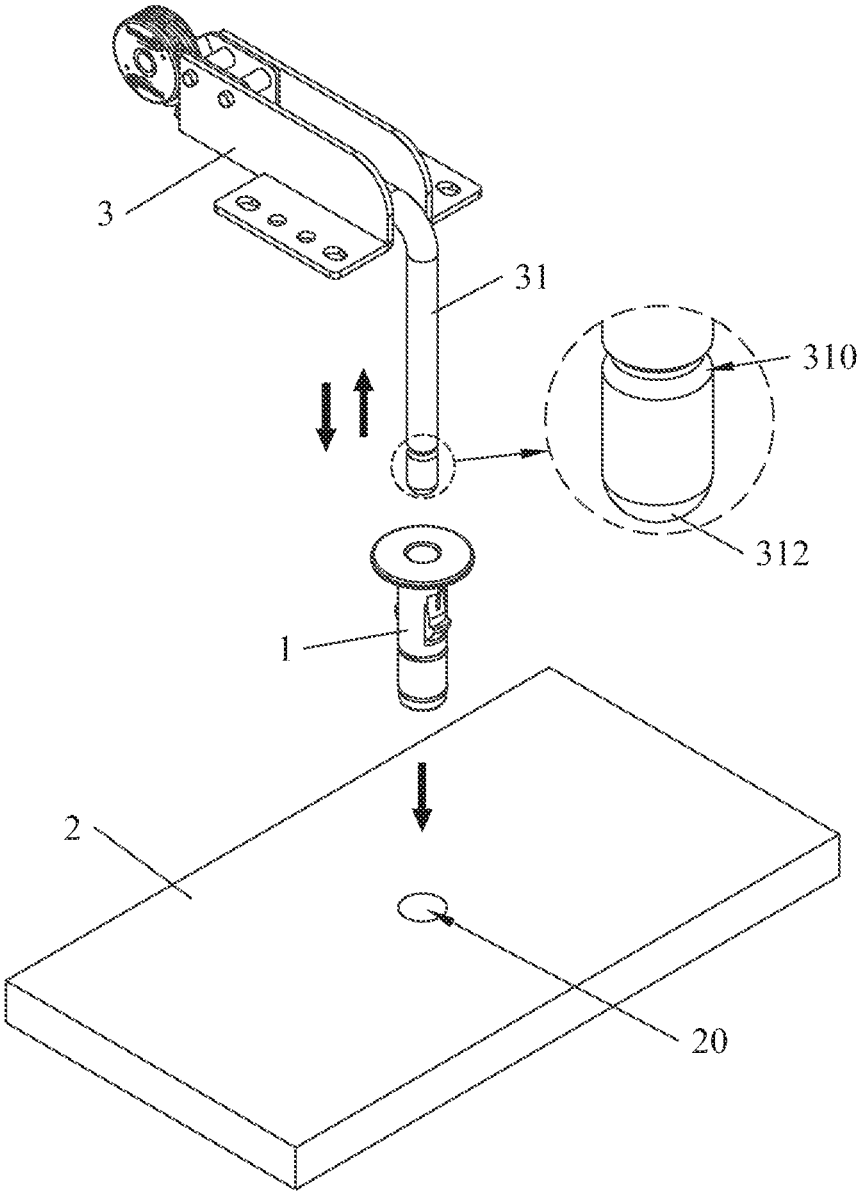
FIG. 3 is a perspective view of a sleeve for installing hinge, a hinge and a top plate of the present invention.

As illustrated in FIG. 3, the sleeve for installing hinge 1 of the present invention is provided, which is installed in a top plate 2 of a sofa body and adapted for installing a hinge 3. A mounting hole 20 is opened in the top plate 2, and the sleeve for installing hinge 1 is inserted and positioned in the mounting hole 20. The hinge 3 includes a straight bar 31, a engaging groove 310 is opened around a side wall of a lower end of the straight bar 31, a positioning portion 312 is projected at a bottom of the straight bar 31.

Figure 4:
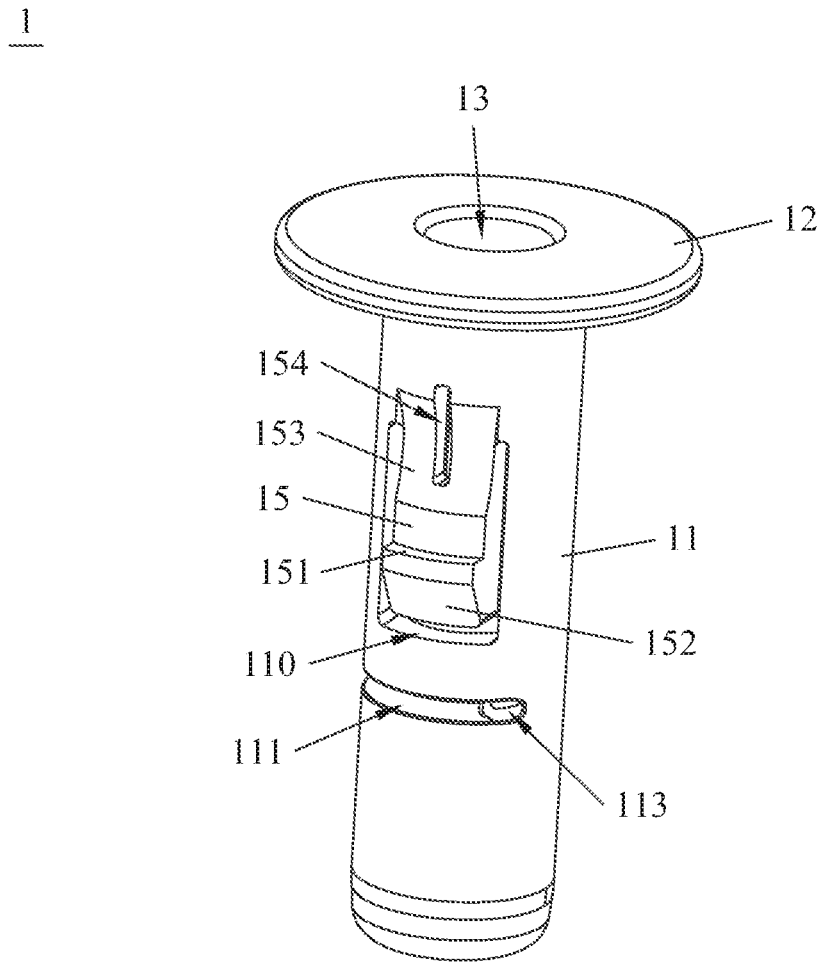
FIG. 4 is a perspective view of the sleeve for installing hinge of the present invention.
Figure 5:
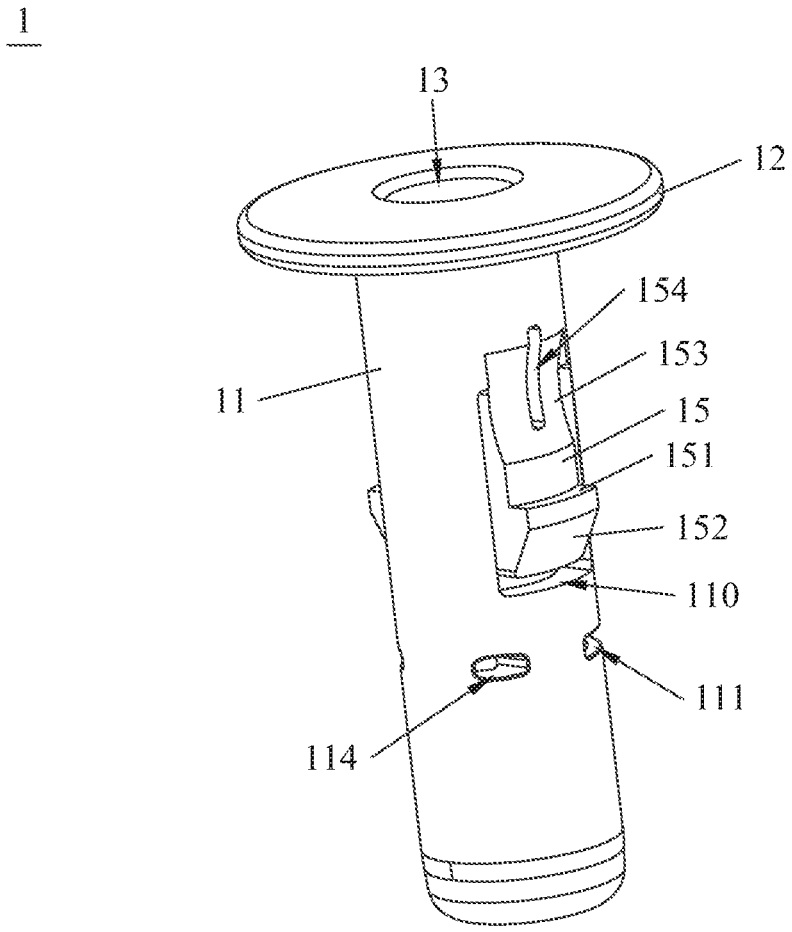
FIG. 5 is another perspective view of the sleeve for installing hinge of the present invention.
Figure 6:
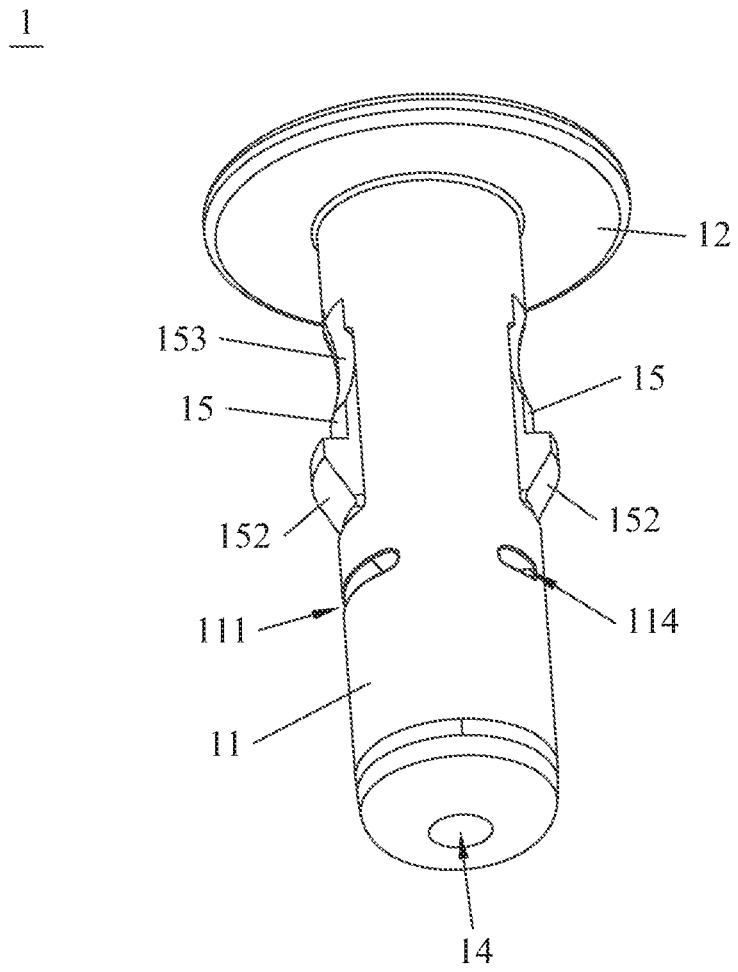
FIG. 6 is the third perspective view of the sleeve for installing hinge of the present invention.

Shown in FIGS. 4 to 6, the hinge sleeve for installing hinge 1 includes a main body 11 capable of inserting into the mounting hole 20 and a stopper 12 fixed to an upper end of the main body 11. The diameter of the main body 11 is smaller then that of the mounting hole 20 so that the main body can be inserted into the mounting hole 20, while the diameter of the stopper 12 is larger than that of the mounting hole 20, when the main body 11 has been inserted into the mounting hole 20, the stopper 12 is withstood with a top surface of the top plate 2. The main body 11 is substantially in shape of a cylinder, the stopper 12 is in a shape of a disk, and the main body 11 and the stopper 12 is formed integrally. A slot 13 where the straight bar 31 is inserted therein is opened in the sleeve for installing hinge 1, the slot 13 passes through the stopper 12 and extends down into the main body 11, but the slot 13 does not pass through the main body 11. A positioning hole 14 communicating with the slot 13 is opened in the bottom of the slot 13, when the straight bar 31 is inserted in the slot 13, the positioning portion 312 at the bottom of the straight bar 31 engages in the positioning hole 14 so that the straight bar 31 can be positioned in the slot 13. Two hooks 15 are oppositely configured at the side wall of the main body 11. Under normal conditions, a distance of the outer edge of the two hooks 15 is greater than the diameter of the mounting hole 20, the hook 15 is deformed under pressure, and the deformed hook 15 can pass through the mounting hole 20. Concretely, two receiving grooves 110 recessed inwardly is oppositely opened in the side wall of the main body 11, the two receiving grooves 110 communicate with the slot 13, an upper end of the hook 15 is fixed in the receiving groove 110, a stop surface 151 and an inclined surface 152 are configured at a lower end of the hook 15 and located outside the receiving groove 110, The stop surface 151 is disposed horizontally and faceup, and the inclined surface 152 is located under the stop surface 151. The free end (the lower end) of the hook 15 is urged to be deformed when the inclined surface is pressed, and the stop surface 151 and the inclined surface 152 are pressed into the receiving groove 110.

Figure 7:
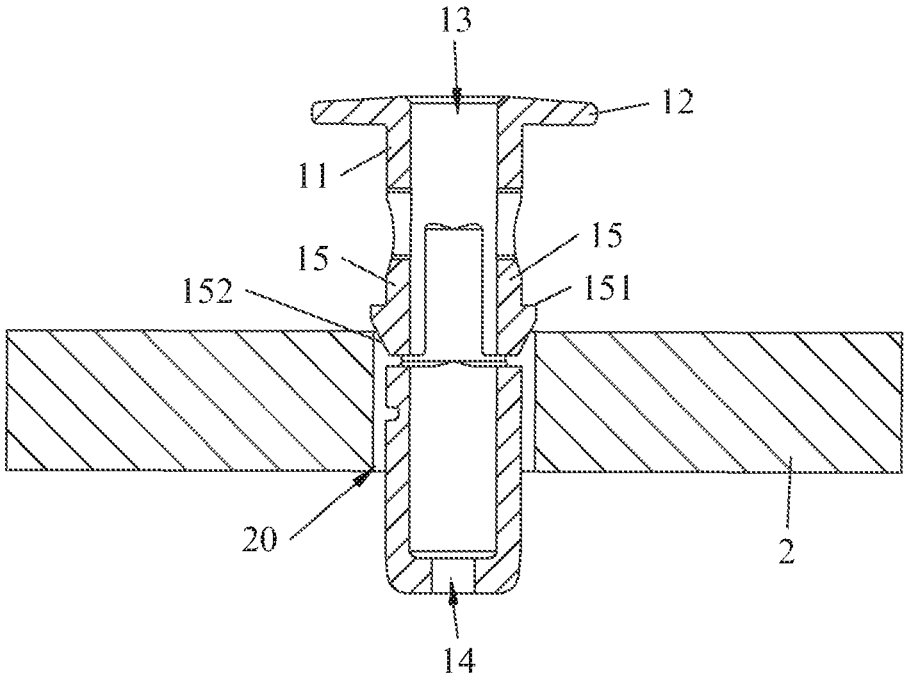
FIG. 7 is a section view of the sleeve for installing hinge when a hook thereof is withstood with the edge of a mounting hole.
Figure 8:
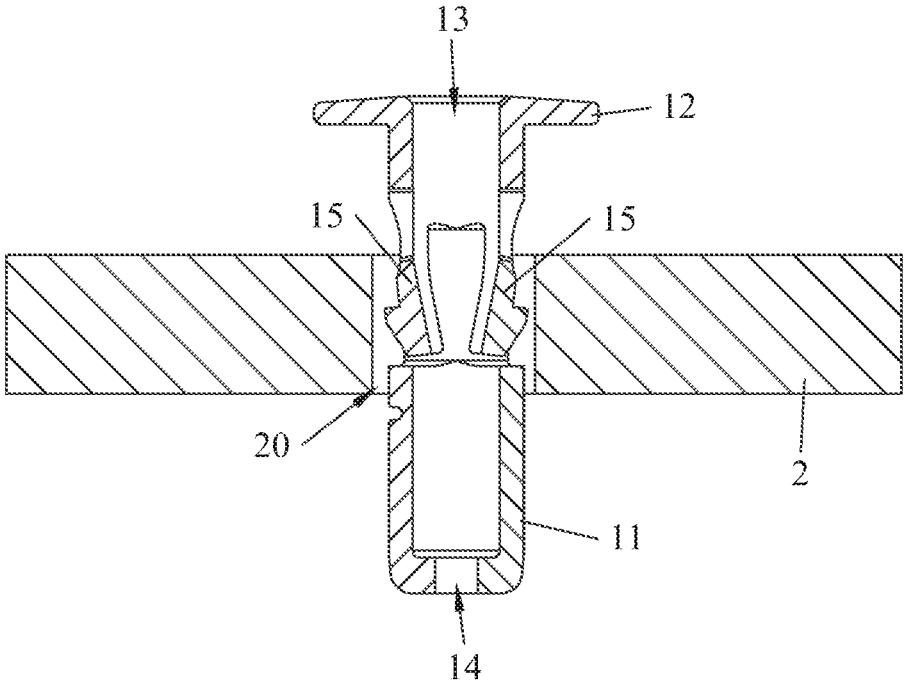
FIG. 8 is a section view of the sleeve for installing hinge when the hook thereof has been deformed.
Figure 9:
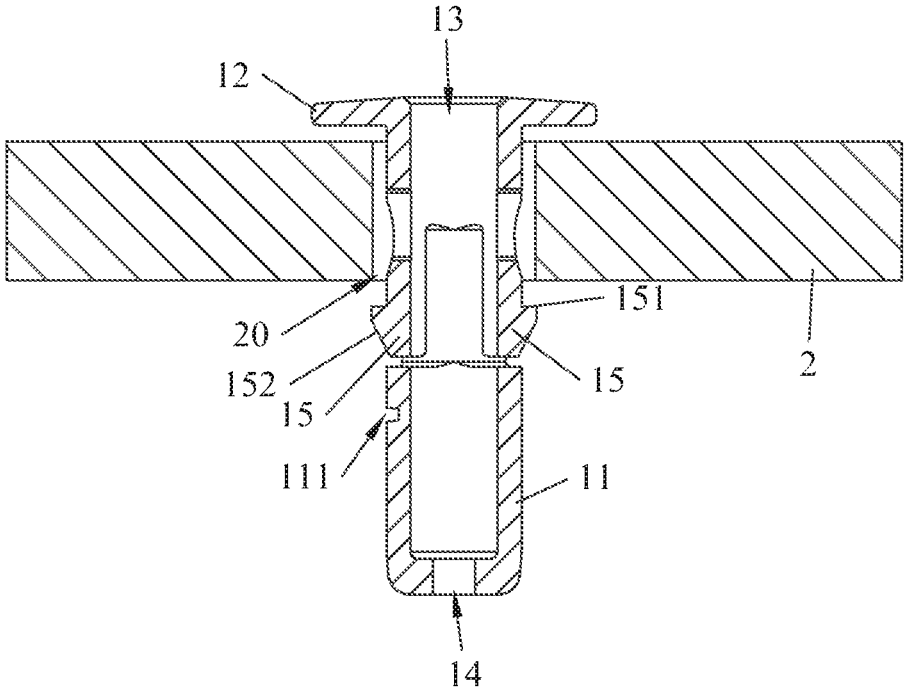
FIG. 9 is a section view of the sleeve for installing hinge when the hook has passed through the mounting hole.
Figure 10:
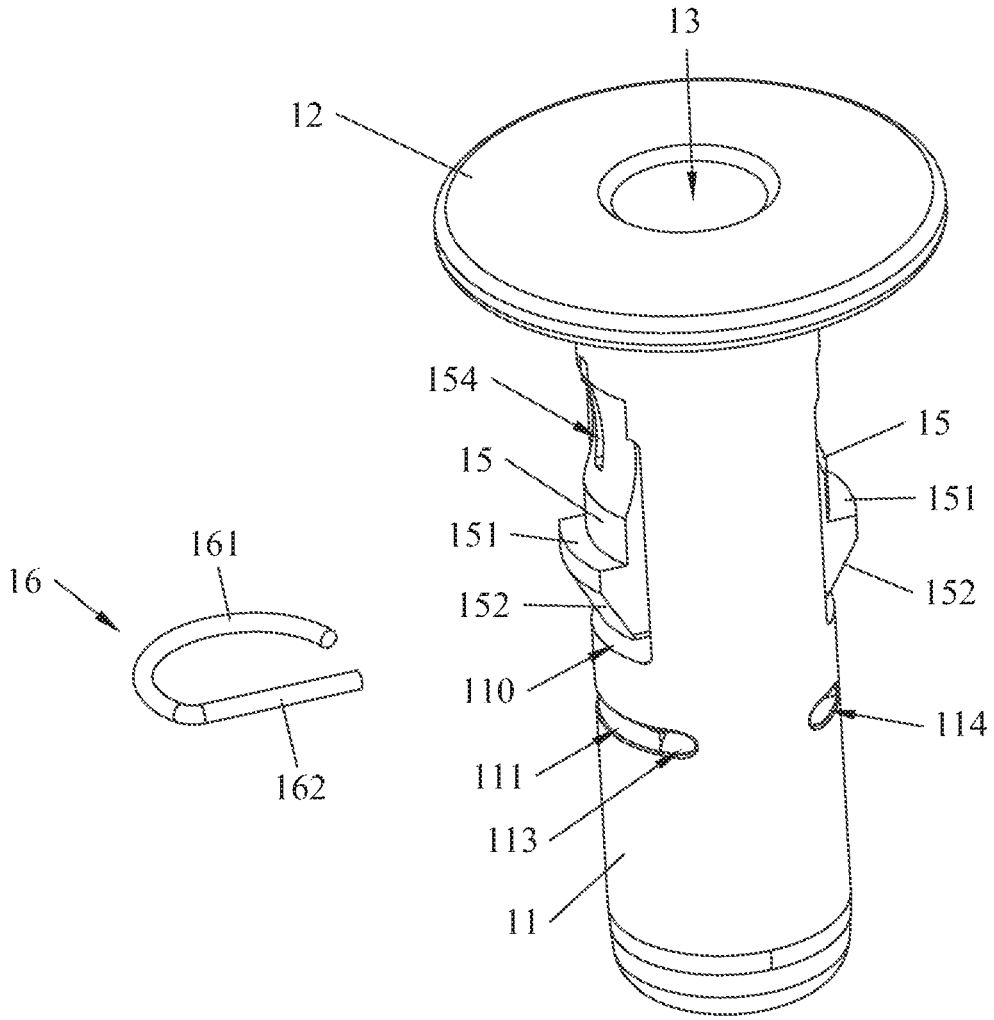
FIG. 10 is a perspective view of the sleeve for installing hinge and a clamp spring.
Figure 11:
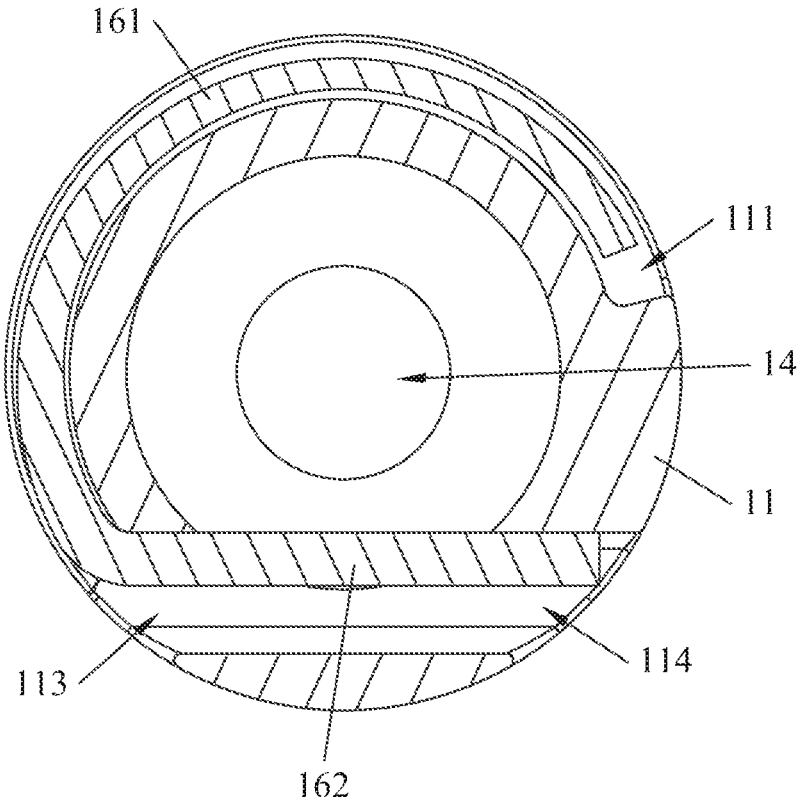
FIG. 11 is a section view of the sleeve for installing hinge and the clamp spring when the clamp spring has been installed in the sleeve for installing hinge.

Referring to FIGS. 7 to 9, when inserting the main body 11 into the mounting hole 20, the inclined surface 152 at the lower end of the two hooks 15 contacts with the edge of the mounting hole 20, under the limitation of the edge of the mounting hole 20, the inclined surface 152 urges the lower end of the hook 15 to be deformed and received in the receiving groove 110, thereby the main body 11 and the two hooks 15 are allowed to pass through the mounting hole 20. When the hook has passed through the mounting hole 20, the hook 15 regains its initial shape, the stop surface 151 of the hook 15 faces the bottom surface of the top plate 2. The stopper 12 the stop surface 151 together position the sleeve for installing hinge 1 on the top plate 2. When the sleeve for installing hinge 1 need to be removed, simply pressing the lower ends of the two hooks 15, and the stop surface 151 of the hook 15 is pressed into the receiving groove 110 so that the sleeve for installing hinge 1 can be pulled out upwardly.

Referring to FIGS. 4~6 and 10~11, a recessed positioning groove 111 is opened in the side wall of the main body 11, the positioning groove 111 is located below the hook 15. The positioning groove 111 extends along the side wall of the main body that is in a shape of a cylinder, so the positioning groove 111 is in a shape of an arc. The positioning groove 111 does not pass through the side wall of the main body 11 and does not communicate with the slot 13. When the positioning portion 312 of the straight bar 31 has been inserted into the positioning hole 14, the engaging groove 310 of the straight bar 31 and the positioning groove 111 are at the same elevation. A first through hole 113 is opened in a bottom surface of one end of the positioning groove 111, the first through hole 111 passes through the side wall of the main body 11 and communicates with the slot 13, a second through hole 114 opposite to the first through hole 113 is opened through the side wall of the main body 11, the second through hole 114 communicates with the first through hole 113 via the slot 13. A clamp spring 16 engages in the positioning groove 111 and extends into the slot 13 to lock the straight bar 31. Concretely, the clamp spring 16 is an irregular clamp spring, the clamp spring 16 includes an curved edge 161 and a straight edge 162, the curved edge 161 engages in the curved positioning groove 111, one end of the straight edge 162 is fixed to the curved edge 161, the straight edge 162 enters into the slot 13 through the first through hole 113 and engages in the engaging groove 310, the other end of the straight edge 162 extends into the second through hole 114. As the clamp spring 16 is configured in the positioning groove 111 and a portion thereof engages in the engaging groove 310 of the straight bar 31, so the straight bar 31 can be locked in the slot 13, unless removing the clamp spring 16, the hinge 3 can not be removed from the sleeve for installing hinge 1.

In other embodiment, the positioning groove 111 may be configured to be in a symmetrical shape, that is, two first through holes 113 are respectively opened in two ends of the positioning groove 111, and the second through hole 113 is needless. The clamp spring in this embodiment is in a symmetrical shape, two ends of the clamp spring respectively pass through the two first through holes 113 and both engage in the engaging groove 310 of the straight bar 31.

Return to FIG. 4, the outer surface of the upper end of the hook 15 is a concave surface 153 that is slightly inwardly curved, and an elongated slot 154 is opened through the concave surface 153. The concave surface 153 and the elongated slot 154 are configured to reduce the structural rigidity of the hook 15, so that the hook 15 can be easily deformed.

In comparison with the prior art, the side wall of the main body 11 of the sleeve for installing hinge 1 is provided with the hook 15 capable of being deformed, when installing the sleeve for installing hinge 1, simply compress and deform the hook 15 so that the main body 11 can be inserted into the mounting hole 20 in the top plate 2, after inserting the main body 11, the stopper 12 of the main body 11 is withstood with the top surface of the top plate 2, and the hook 15 regains its initial shape, the stop surface 151 thereof is located under the bottom surface and faces the bottom surface, the stopper 12 and the stop surface 151 together position the sleeve for installing hinge 1 in the top plate 2, then the hinge 3 can be inserted in the slot 13 on the sleeve for installing hinge 1, and then the installation is completed. The installation process is quick and easy. Further, the sleeve for installing hinge 1 without thread can be made of plastic and other materials, which saves manufacturing costs.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A sleeve for installing hinge, installed in a top plate of a sofa body and adapted for installing a hinge, a mounting hole being opened in the top plate, wherein the sleeve for installing hinge comprises a main body capable of inserting into the mounting hole and a stopper fixed to an upper end of the main body and withstood with a top surface of the top plate, the sleeve for installing hinge further includes a slot where the hinge is inserted therein, the slot passes through the stopper and extends down into the main body, a hook is configured at a side wall of the main body, the hook is deformed under pressure so as to allow the main body and the hook to pass through the mounting hole, the hook has a stop surface facing up, after the main body and the hook pass through the mounting hole, the stop surface faces a bottom surface of the top plate;

wherein a recessed positioning groove is opened in the side wall of the main body, a first through hole is opened in a bottom surface of one end of the positioning groove, the first through hole passes through the side wall of the main body and communicates with the slot, one end of the hinge inserted into the slot has an engaging groove, a clamp spring is configured in the positioning groove, and a portion of the clamp spring extends into the slot through the first through hole and engages in the engaging groove.

2. The sleeve for installing hinge according to claim 1, wherein a receiving groove recessed inwardly is opened in the side wall of the main body, an upper end of the hook is configured in the receiving groove, the stop surface is configured at a lower end of the hook and located outside the receiving groove, and the stop surface is pressed into the receiving groove when the hook is deformed.

3. The sleeve for installing hinge according to claim 2, wherein the lower end of the hook further comprises an inclined surface located under the stop surface and outside the receiving groove, and the hook is urged to be deformed by the inclined surface under pressure.

4. The sleeve for installing hinge according to claim 2, wherein the receiving groove communicates with the slot.

5. The sleeve for installing hinge according to claim 2, wherein the number of the receiving groove is two, and each of the two receiving grooves is provided with one said hook.

6. The sleeve for installing hinge according to claim 1, wherein the main body is in a shape of a cylinder, the positioning groove is in a shape of a circular arc.

7. The sleeve for installing hinge according to claim 6, wherein a second through hole opposite to the first through hole is opened through the side wall of the main body, the clamp spring comprises an curved edge and a straight edge, the curved edge engages in the positioning groove, one end of the straight edge is fixed to the curved edge, the straight edge enters into the slot and engages in the engaging groove, the other end of the straight edge extends into the second through hole.

8. The sleeve for installing hinge according to claim 1, wherein when a tail end of the hinge is withstood with a bottom of the slot, the engaging groove and the positioning groove are at the same elevation.

9. The sleeve for installing hinge according to claim 8, wherein a positioning hole is opened in the bottom of the slot, the tail end of the hinge has a positioning portion, the positioning portion engages in the positioning hole.

* * * * *